United States Patent [19]

Cordiano et al.

[11] 3,948,747

[45] Apr. 6, 1976

[54] ELIMINATION OR CONTROL OF ACID MISTS OVER ELECTROLYTIC CELLS

[75] Inventors: Joseph J. Cordiano; Walter L. Brytczuk, both of Roselle Park, N.J.

[73] Assignee: Amax Inc., New York, N.Y.

[22] Filed: May 9, 1975

[21] Appl. No.: 576,138

[52] U.S. Cl. ..... 204/242; 204/DIG. 1

[51] Int. Cl.[2] ..... C25D 1/00

[58] Field of Search ..... 204/194, 242, 279, DIG. 1

[56] References Cited

UNITED STATES PATENTS 633,272 9/1899 Parker ..... 204/DIG. 1

2,710,832 6/1955 Harr ..... 204/DIG. 1

*Primary Examiner*—T. M. Tufariello

*Attorney, Agent, or Firm*—Kasper T. Serijan; Eugene J. Kalil

[57] ABSTRACT

The formation of acid mist or spray over electroplating tanks, such as in the electrowinning of copper, is substantially inhibited by utilizing a tank system in which the surface of the electrolyte has floating thereon a freely movable assembly of floatable elongated members arranged parallel with the electrodes therein across the surface of the electrolyte between the electrodes and extending beyond the sides of the electrodes in parallel self-locating relationship.

8 Claims, 2 Drawing Figures

ELIMINATION OR CONTROL OF ACID MISTS OVER ELECTROLYTIC CELLS

This invention relates to the inhibition of acid mist or spray over electroplating tanks and, in particular, to an electroplating system having means provided for substantially inhibiting formation of acid mist or spray.

State of the Art

It is known in the electrowinning of copper or other electroplating systems involving large scale handling of electrolyte and also involving the use of large cathodes and anodes to employ means to inhibit the formation of acid mist over the plating tanks, the mist being hazardous to the health of tank attendants. The acid mist is due to considerable evolution of gas at the electrodes.

Previous solutions proposed included forming a foam layer on the surface; mechanical interference layers, such as floating glass and plastic balls, pellets or other small shapes; and means for hooding and venting gases through collectors.

However, the foregoing systems have distinct disadvantages, especially when employed in cells where it is necessary to remove electrodes frequently, such as daily or several times a day.

The use of foam layers of certain oils or chemical compounds often interferes with providing a good deposit due to partial solubility of the substance in the electrolyte or due to coating of the electrodes when pulling out and replacing the electrodes through the foam layer.

The use of small floating pellets or balls (glass or plastic) tends to give an irregular top edge to the deposit on the cathode. The irregular top edge on starter cathodes following metal deposition has to be trimmed off to provide a commercially acceptable product. Also, small plastic or glass balls do not retain their relative positions and are easily carried away by electrolyte flow during recycling of the electrolyte.

It would be desirable to provide an improved electroplating system in which acid mist is substantially inhibited without the disadvantages of the foregoing systems.

Objects of the Invention

One object of the invention is to provide an electroplating system in which the formation of acid mist over the plating tank is substantially inhibited.

Another object is to provide an electroplating system having mechanical means associated with the surface of the electrolyte for inhibiting acid mist from emanating from the electrolyte during electroplating.

Figure 1:
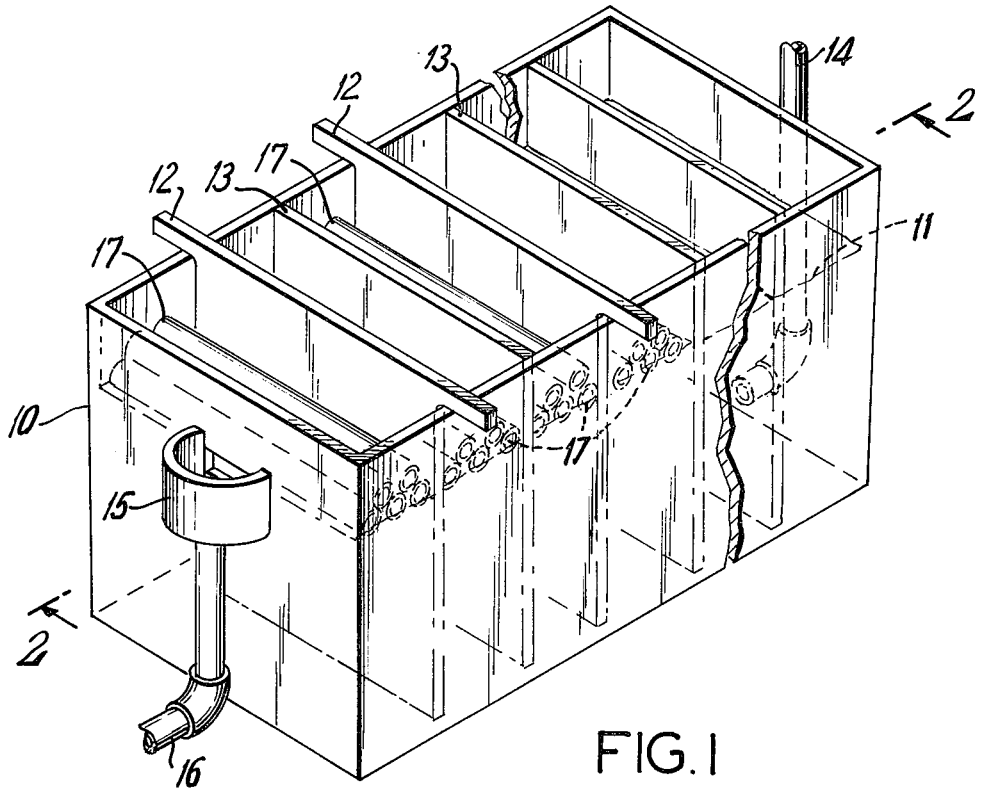
Figure 2:
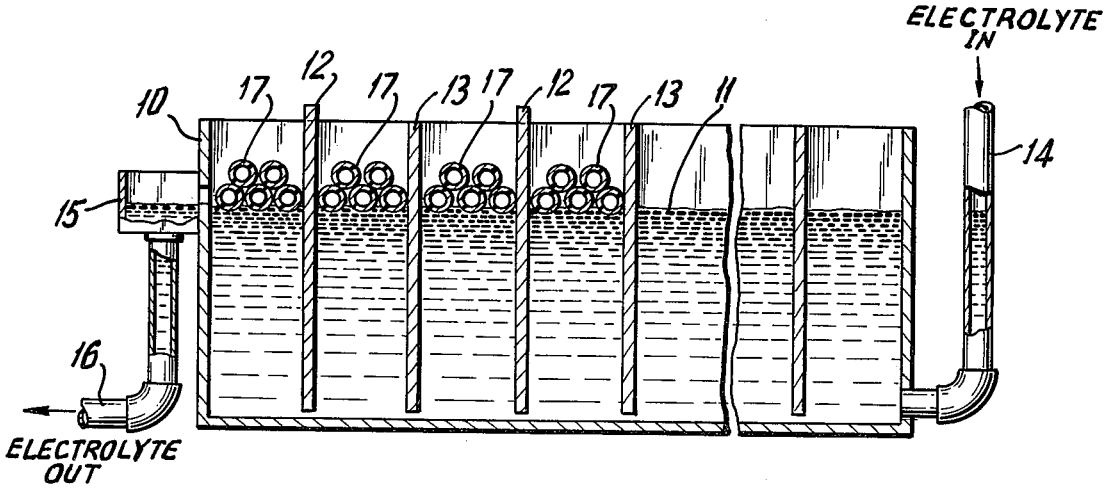

These and other objects will more clearly appear when taken in conjunction with the following disclosure and claims and the accompanying drawing, wherein:

FIG. 1 is a fragmented perspective of an electrolytic tank showing one embodiment of the invention; and FIG. 2 is a cross section of said tank taken along line 2—2.

Broad Statement of the Invention

The invention is directed to an electroplating system in which the formation of acid mist over the electrolyte is substantially inhibited from forming by maintaining on the top of the electrolyte between the electrodes therein a freely movable assembly of floatable elongated members arranged in parallel, substantially close-packed, self-locating relationship with each other, such that the electrolyte surface is covered by said floating members, said elongated members being arranged substantially parallel to the electrodes and extending at least across the width of said electrodes. The material of the memers should be electrically non-conductive or coated to be non-conductive in order to avoid shorts across the electrode with which the members come in contact.

In its more preferred aspects, the system comprises a tank having an electrolyte confined therein and being of suitable width and length and having at least a pair of spaced apart cathode-anode electrodes suspended across the width of said tank and extending downwardly into said electrolyte, wherein the space between the at least said pair of electrodes has disposed thereacross a freely movable assembly of floatable elongated members being arranged in parallel, close-packed, self-locating relationship with the other, such that during electroplating, the formation of acid mist or spray over the tank due to gas evolution at the electrodes is substantially inhibited.

The elongated members are preferably cylindrical but may have a square or other polygonal cross section. The members may comprise rods, open or closed end tubing and even solid rods, provided the density of the elongated members is less than that of the electrolyte and the material thereof is chemically inert to the electrolyte. The material from which the elongated member is made may have a density greater than the electrolyte so long as the member itself has a density less than the electrolyte. For example, a closed end tubing may be made from a material of higher density than the electrolyte. Preferably, the material should have a density below 0.95, for example, below 0.9.

The elongated members may be made from glass, fiberglass, hard wood, rubber, synthetic rubber, plastics, ceramic, coated metals (including alloys) or other inert non-conductive material which when fabricated will float in the electrolyte. Examples of plastics which may be used include polyethylene, polyvinyl chloride, polyurethane, polypropylene and other plastic materials. Polyethylene may range in density from as low as 0.91 grs/cm$^3$ to as high as 0.95. Polypropylene has a density of about 0.9. Foamed plastics having very low overall density may be employed, e.g. foamed polyurethane. Plastic coated wood may similarly be employed.

Plastic hollow tubes are preferred because of their lightness and because they can be stacked to provide at least two layers in parallel close-packed, self-locating relationship within the confined space between the electrodes.

Details of the Invention

The preferred embodiment of the invention will be clearly apparent from FIGS. 1 and 2 of the drawing, FIG. 2 being a cross section of FIG. 1 taken along line 2—2 looking in the direction of the arrows.

Thus, referring to the figures, a copper electrorefining tank 10 is shown containing a copper sulfate electrolyte 11 (FIG. 2) into which is hung an arrangement of spaced apart cathode-anode electrodes 12 and 13, respectively, the current in the tank flowing from the anodes to the cathodes.

The electrolyte in the tank is circulated via electrolyte inlet pipe 14 and overflow box 15 via pipe 16. In the spaces between the end walls of the tank and the electrodes and between the pairs of cathode-anode electrodes is provided a floating assembly of closed end polyethylene tubing 17 arranged across the width of the tank parallel to each other and to the cathodes and anodes as shown, each tube member being longer than the width of the electrodes, the tubes being in close-packed, self-locating relationship so as to provide a path of resistance to acid mist tending to form during gassing at the electrodes.

The use of rods or tubes in one, two or more layers on the electrolyte surface provides a mist-collecting system through which the electrodes can be removed and replaced without any serious disturbance to the process and without any undue hardship, such as exposure of tank attendants to irritating acid mist. The use of parallel arranged rods or tubes provides the additional advantage of assuring a substantially even straight line deposit at the top edge of the cathodes upon which the copper or other metal is deposited.

The use of elongated members is further advantageous in that there is no longer need of installing screens in the overflow boxes and pipes to prevent the mist-collecting device from flowing out of the tank and into the pumps as is apt to occur with small hollow plastic or glass balls.

Although the present invention has been described in conjuction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In an electroplating system comprising a tank with an electrolyte and electrodes supported therein, the improvement comprising an assembly of freely movable, floatable, non-conductive elongated members chemically inert to the electrolyte and arranged to cover the surface of the electrolyte in parallel, close-packed, self-locating relationship with each other, the assembly of said elongated members being substantially parallel to the electrodes, with the length thereof longer than the width of the electrode, such that the formation of acid mist over the tank due to gas evolution at the electrodes is substantially inhibited.

2. The electroplating system of claim 1, wherein said floatable elongated members are either hollow or solid and wherein said electrodes comprise a plurality of pairs of cathode-anode electrodes with said assembly of members disposed in the spaces between said pairs of electrodes.

3. The electroplating system of claim 2, wherein the floatable elongated members are made from a material selected from the group consisting of glass, fiberglass, plastic, hardwood, rubber, ceramic and metals coated with a non-conductive material.

4. The electroplating system of claim 3, wherein said elongated members are made of plastic materials selected from the group of plastics consisting of polyethylene, polyvinyl chloride, polypropylene, and polyurethane.

5. In an electroplating system for the electrolytic deposition of metal, said system comprising a tank having an electrolyte confined therein and being of suitable width and length and having at least one pair of spaced apart cathode-anode electrodes suspended across the width of said tank and extending downwardly into said electrolyte, said surface of said electrolyte being exposed, the improvement, wherein said electrolyte surface is covered with an assembly of freely movable, floatable, non-conductive elongated members chemically inert to the electrolyte disposed across the width of said tank, said freely movable assembly of members being in parallel, close-packed selflocating relationship and parallel with said electrodes, said members having a length greater than the width of the electrodes, such that during electroplating, the formation of acid mist or spray over the tank due to gas evolution at the electrodes is substantially inhibited.

6. The electroplating system of claim 4, wherein said elongated members are either hollow or solid and wherein said electrodes comprise a plurality of pairs of cathodeanode electrodes with said freely movable assembly of members disposed in the spaces between said pairs of electrodes.

7. The electroplating system of claim 6, wherein the floatable elongated members are made from a material selected from the group consisting of glass, fiberglass, plastic, hardwood, rubber, ceramic and metals coated with a non-conductive material.

8. The electroplating system of claim 7, wherein said elongated members are made of plastic materials selected from the group of plastics consisting of polyethylene, polyvinyl chloride, polypropylene, and polyurethane.

* * * * *